US007655287B2

(12) United States Patent
Yoshida et al.

(10) Patent No.: US 7,655,287 B2
(45) Date of Patent: Feb. 2, 2010

(54) INKJET RECORDING MEDIUM

(75) Inventors: Yoshio Yoshida, Tokyo (JP); Shoichi Endo, Tokyo (JP); Masanori Kawashima, Tokyo (JP); Susumu Hagisawa, Tokyo (JP); Takayuki Fujimoto, Tokyo (JP); Masaya Tosaka, Tokyo (JP); Yuu Suzuki, Tokyo (JP); Kaoru Hamada, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 10/535,387

(22) PCT Filed: Mar. 29, 2004

(86) PCT No.: PCT/JP2004/004437

§ 371 (c)(1),
(2), (4) Date: May 17, 2005

(87) PCT Pub. No.: WO2004/087431

PCT Pub. Date: Oct. 14, 2004

(65) Prior Publication Data

US 2006/0050130 A1 Mar. 9, 2006

(30) Foreign Application Priority Data

| | | |
|---|---|---|
| Mar. 31, 2003 | (JP) | 2003-094211 |
| Jul. 15, 2003 | (JP) | 2003-274545 |
| Sep. 30, 2003 | (JP) | 2003-339530 |
| Jan. 30, 2004 | (JP) | 2004-023061 |
| Mar. 24, 2004 | (JP) | 2004-086338 |

(51) Int. Cl.
*B41M 5/40* (2006.01)

(52) U.S. Cl. ..... 428/32.28; 428/32.33; 428/32.35; 428/32.37

(58) Field of Classification Search ..... 428/32.15, 428/32.28, 32.33, 32.35, 32.37
See application file for complete search history.

(56) References Cited

U.S. PATENT DOCUMENTS

| | | | | |
|---|---|---|---|---|
| 5,281,467 | A | 1/1994 | Shimada et al. | |
| 6,183,851 | B1 * | 2/2001 | Mishima | 428/32.34 |
| 6,238,784 | B1 | 5/2001 | Mochizuki et al. | |
| 6,410,123 | B1 | 6/2002 | Otani et al. | |
| 6,485,812 | B1 * | 11/2002 | Sekiguchi | 428/32.29 |
| 6,773,770 | B1 | 8/2004 | Sugiyama et al. | |
| 6,846,524 | B2 | 1/2005 | Ozawa et al. | |
| 2001/0036552 | A1 * | 11/2001 | Otani et al. | 428/411.1 |
| 2002/0176970 | A1 * | 11/2002 | Kobayashi et al. | 428/195 |
| 2004/0063844 | A1 * | 4/2004 | Urs | 524/492 |

FOREIGN PATENT DOCUMENTS

| | | | |
|---|---|---|---|
| JP | 59-169922 | | 9/1984 |
| JP | 62-095285 | | 5/1987 |
| JP | 05-338348 | | 12/1993 |
| JP | 06-305237 | | 11/1994 |
| JP | 09-263039 | | 10/1997 |
| JP | 11-020306 | A | 1/1999 |
| JP | 11-034481 | | 2/1999 |
| JP | 2000-62314 | | 2/2000 |
| JP | 2000-85242 | | 3/2000 |
| JP | 2000-108505 | | 4/2000 |
| JP | 2000-108506 | | 4/2000 |
| JP | 2001-270238 | | 10/2001 |
| JP | 2002-166645 | | 6/2002 |
| JP | 2002-248850 | A | 9/2002 |
| JP | 2002-248851 | A | 9/2002 |
| JP | 2002-362010 | | 12/2002 |
| JP | 2003-145916 | | 5/2003 |

OTHER PUBLICATIONS

AEROSIL Datasheet (Internet Print-Out) Feb. 12, 2003.*
Nissan Chemical American Corporation —SNOWTEX—.*
U.S. Appl. No. 10/541,300.
U.S. Appl. No. 10/532,531.
U.S. Appl. No. 10/524,480.

* cited by examiner

*Primary Examiner*—Betelhem Shewareged
(74) *Attorney, Agent, or Firm*—Gary C. Cohn PLLC

(57) ABSTRACT

An inkjet recording medium obtained by forming a coating layer containing a pigment and a binder on the surface of a base material and coating layer is subsequently pressed onto a heated mirror finished surface to dry to form an ink absorbing layer through a cast coating method, wherein pigment contains a colloidal silica that has a primary particle diameter of from 10 nm to 100 nm while the ratio of the secondary particle diameter to primary particle diameter is from 1.5 to 3.0.

20 Claims, No Drawings

INKJET RECORDING MEDIUM

BACKGROUND OF THE INVENTION

1. Field of the Invention

The present invention relates to an inkjet recording medium. More specifically, the present invention relates to an inkjet recording medium preferable for use with both dye and pigment inks.

2. Description of the Prior Art

Inkjet recording generally involves ejecting small droplets of ink using various mechanisms and forming dots by allowing the droplets to adhere to a recording medium. Inkjet recording is less noisy than dot impact recording, can readily provide full color prints, and offers the advantage of potential utility for high speed printing.

Ink jet recording processes are traditionally conducted using mainly aqueous dye inks. Such aqueous dye inks use low molecular weight dye compounds as coloring agents. Although these compounds develop color well, they also have problems. For example, they blur easily when exposed to water and the like, and the colors fade and change upon extended exposures to light and gases due to the structure of the coloring agents resulting in problems associated with preservative property of recorded images and image durability.

Therefore, inks formed using pigments as coloring agents were put into practice in order to overcome the problems associated with dye based inks and to improve waterfastness and lightfastness. (See, for example, Unexamined Japanese Patent Publications (Kokai) Hei 11-20306, 2000-79752 and 2003-145916.) However, when a pigment based ink is used to print on a conventional inkjet recording medium designed for dye based inks, problems occurred as optical (image) density declined and lack of solid image uniformity. Furthermore, when a larger amount of pigment based ink is ejected in order to promote better color development, the coloring agents accumulate on the recording medium surface resulting in lowered abrasion resistance, staining of printed materials and disruption of the ink solvent absorption due to the accumulation of coloring agents.

Therefore, dyes and pigments have recently been used simultaneously in inkjet recording inks, and a recording medium compatible with both dye based and pigment based inks is urgently needed. A technology to improve the recording property of both dye based and pigment based inks by adding a fine inorganic particles and an adhesive comprising a vinyl chloride-vinyl acetate copolymer to the ink absorbing layer has been disclosed. (See, for example, Unexamined Japanese Patent Publication (Kokai) 2001-270238.) However, this technology failed to yield a satisfactory printing property, particularly when ink absorption and optical density in printing using a pigment based ink are concerned.

Simultaneously, opportunities to output (print hard copy of) high resolution images using inkjet printers are increasing due to the popularity of high resolution digital video, digital cameras, scanners and personal computers. As a result, new demands are placed on inkjet recording media. That is, faster ink drying speed, high optical density, the absence of ink blurring and bleeding, and the absence of cockle upon ink absorption as well as providing gloss comparable to that of silver halide photographs are in demand.

In order to satisfy these properties, a technology to manufacture recording media using a cast coating method has been proposed. (See, for example, Unexamined Japanese Patent Publications (Kokai) Sho 62-95285, Hei 02-274587, Hei 05-59694, Hei 06-305237, Hei 09-156210 and Hei 11-48604.) The cast coating method proposed in these publications yields a high gloss cast coated paper by applying an ink receiving layer comprising a pigment, the major components of which are a synthetic silica, and a binder, pressing said layer onto a heated mirror finished surface while the layer is still wet to transfer the mirror finished surface and simultaneously dry it. However, the gloss of the outermost surface layer is still inadequate and a gloss, comparable to that of a silver halide photograph cannot be obtained-even using this technology. In addition, the recording property using a pigment ink is not good.

An addition of 5-50 nm spherical colloidal silica into the abovementioned cast layer is tried to obtain a high gloss, whrein the silica is dispersed in water to form a stable colloid that does not undergo secondary aggregation. (See Unexamined. Japanese Patent Publications (Kokai) Hei 05-338348 and Hei 10-217599.) This colloidal silica is composed of fine particles, and a very clear and high gloss coating film is obtained when it is dried. In addition, technologies in which said cast layer contains (1) fine silica particles having an average particle diameter for primary particles of 3 nm to 40 nm and an average particle diameter for secondary particles of 10 nm to 400 nm, and (2) colloidal silica having an average particle diameter of 200 nm or less have been reported. (See, for example, Unexamined Japanese Patent Publication (Kokai) 2000-85242.)

However, almost all colloidal silica consists of truly spherical particles, and primary particles are singly dispersed without aggregation. Therefore, the particles are tightly packed when dried, and very little inter-particulate gaps exist. As a result, the pore volume obtained using colloidal silica is generally low, under 0.4 ml/g. When this silica is added to a cast layer, the ink absorption rate is slowed and causes inks blurring and uneven image density.

In addition, a recording paper on which a glossy layer containing a pearl necklace (beaded) type colloidal silica and the like is applied over an ink absorbing layer without using a cast coating method has been proposed. (See. Unexamined Japanese Patent Publications (Kokai) 2000-108505, 2000-108506 and 2000-62314.) Furthermore, a technology in which an ink absorbing layer is constructed from more than one layer and at least one of the layers contains a cationic resin and colloidal particles having an average particle diameter of 300 nm or less has been reported. (See, for example, Unexamined Japanese Patent Publication (Kokai)-Hei 09263039.)

This technology is good for developing color and absorbing ink when with a dye ink. However, ink particles do not anchor well into a glossy layer and images break apart when they are touched and images stain other white paper section when a pigment ink containing coloring particles having a particle diameter of from 50 nm to 150 nm is used.

Alternatively, fine synthetic silica particles formed using a vapor phase method were added to an ink absorption layer. (See Unexamined Japanese Patent Publications (Kokai) Hei 10-81064 and Hei 11-34481.) Silica formed using a vapor phase method is composed of super fine particles, the average particle diameter of primary particles is from several nanometers to several tens of nm, have excellent dispersion properties, have excellent transparency, are bulky and are more readily converted into aqueous dispersions than silica formed using a wet method. A high gloss coating film having good ink absorption properties can be formed when such an aqueous dispersion is, coated. Silica formed using a vapor phase method can be manufactured by exposing a volatile silicon compound to a flame to induce decomposition at high temperatures. (See, for example, Unexamined Japanese Patent Publication (Kokai) Sho 59-169922.)

However, the inter-particulate bonding of aggregated particles of silica formed using a vapor phase method is relatively weak, and the aggregated state is disrupted by the capillary force generated by the voids created when water is dried to form a coating film. The cast layer tends to form fine, turtle shell-like cracks that may be observed by optical microscope.

As described here, the abovementioned problems are encountered when a colloidal silica having a small particle diameter or a silica formed using a vapor phase method is used to achieve a high gloss.

In addition, a so-called uneven printing is sometimes encountered, particularly in cyan-colored printings, as recording media become glossier. Printing non-uniformity refers here to uneven image density when a solid image is printed using an inkjet recording method.

SUMMARY OF THE INVENTION

Therefore, the object of the present invention is to provide an inkjet recording medium having good inkjet recording properties as well as gloss comparable to that of a silver halide photograph in inkjet recording using both dye and pigment inks.

The inventors studied in order to solve the problems described above. As a result, the inventors discovered that an inkjet recording medium having good inkjet recording properties regardless of whether a dye based ink or a pigment based ink is used can be obtained by including a colloidal silica having a specific shape as a pigment in an ink absorbing layer.

In, addition, the inventors discovered that a gloss comparable to that of a silver halide photograph could be obtained when manufacturing the inkjet recording mediums described above by applying a solution that acts to coagulate a binder to the surface of a coating layer containing a pigment and a binder, and subsequently pressing the coating layer while wet to a heated mirror finished surface to dry the coating layer.

That is, the present invention describes an inkjet recording medium obtained by forming a coating layer containing a pigment and a binder on the surface of a base material, a treatment solution used to coagulate said binder is subsequently applied to said coating layer surface while wet and the coating layer on which said treatment solution is applied is pressed on to a heated mirror finished surface while said coating layer is wet to dry the layer to form an ink absorbing layer, wherein said pigment contains a colloidal silica that has a primary particle diameter of from 10 nm to 100 nm while the ratio of the secondary particle diameter to said primary particle diameter is from 1.5 to 3.0.

Preferably, in the present invention an undercoating layer is formed between said base material and said ink absorbing layer.

Preferably, the primary particle diameter of said colloidal silica is from 10 nm to 50 nm and said pigment also contains γ-type alumina. In one preferred mode, the primary particle diameter of said colloidal silica is from 10 nm to 50 nm and said pigment also contains silica formed using a vapor phase method and having a specific surface area of from 130 $m^2/g$ to 300 $m^2/g$. And preferably, the primary particle diameter of said colloidal silica is from 30 nm to 100 nm and said pigment also contains a synthetic non-crystalline silica formed using a wet method. Preferably, the content of said colloidal silica is from 5% by weight to 50% by weight based on total pigment in said ink absorbing layer.

Furthermore, preferably, said binder contains a water soluble resin, said binder contains poly(vinyl alcohol) and/or a poly(vinyl alcohol) derivative. In addition, preferably, the ratio by weight of the pigment and the binder in said ink absorbing layer satisfies the relationship (pigment)/(binder) =from 100/3 to 0.100/50, the 75° specular gloss of said ink absorbing layer surface is at least 50% and the degree of image transparency is at least 20%.

DESCRIPTION OF THE PREFERRED EMBODIMENTS (Base Material)

The base material used in the present invention may be any material having air permeability, but paper such as coated paper, uncoated paper and the like, for example, are preferable. Chemical pulp (bleached or unbleached coniferous kraft pulp, bleached or unbleached hard wood kraft pulp and the like), mechanical pulp (ground pulp, thermo-mechanical pulp, chemi-thermo-mechanical pulp and the like), de-inked pulp and the like may be used individually or as a mixture of optional proportions as the raw material pulp for said paper. In addition, the pH of said paper may be acidic, neutral or alkaline. In addition, the presence of a filler in said paper is preferred to improve opacity, and the filler may be appropriately selected from well known fillers such as hydrated silicic acid, white carbon, talc, kaolin, clay, calcium carbonate, titanium oxide, synthetic resin filler and the like. From an operational point of view, air permeability of 1,000 seconds or less is preferred for said paper, and, from a coatability point of view, Stockigt sizing degree of 5 seconds or more is preferred.

[The Pigment in the Ink Absorbing Layer (Peanut-Shaped Colloidal Silica)]

The ink absorbing layer in the present invention contains colloidal silica as a pigment. This colloidal silica is composed of multiple numbers of aggregated primary particles and is characterized by a primary particle diameter of 10 nm to 100 nm and the ratio of the secondary particle diameter to the primary particle diameter being 1.5-3.0. Said colloidal silica is synthesized using a sol-gel method and an alkoxysilane as the starting material. The primary particle diameter (particle diameter measured using BET method) and the secondary particle diameter (particle diameter measured using a dynamic light scattering method) are preferably controlled by the conditions used in the synthesis. When the dispersion state is examined microscopically, two to three spherical primary particles are ordinarily found to be bonded. The resulting shape is referred to as a "peanut shape" for convenience. When the number of primary particles bonded together was averaged, a value almost equal to that of the ratio (secondary particle diameter/primary particle diameter) mentioned above was obtained.

The ink absorption is poor when a single spherical colloidal silica, non-bonded primary particles, is used, but the peanut-shaped colloidal silica has satisfactory gloss, ink color development and ink absorption properties. Quartron, formed by Fuso Chemical Co., Ltd. can be cited as such a colloidal silica.

When the colloidal silica dispersion state of the present invention is microscopically examined silica other than the peanut-shaped colloidal silica does not need to be completely absent. Colloidal silica having other shapes and single primary particles may be present as long as the ratio (a micro property) of the secondary particle diameter to the primary particle diameter measured does not exceed 3.0.

In addition, the colloidal silica of the present invention does not contain finely divided colloidal particles obtained by mechanically treating aggregated primary particles to obtain secondary particles from several 10 s of nm to several 100 s of nm in size.

In the peanut-shaped colloidal silica mentioned above, the ratio (secondary particle diameter/primary particle diameter) of the secondary particle diameter to the primary colloidal silica particle diameter needs to be 1.5-3.0 while the ratio mentioned above of 1.5-2.8 is preferred and 1.5-2.5 is more preferred. When the ratio mentioned above is under 1.5, the ink absorption declines due to the presence of very little void space after a film is formed although the transparency of the ink absorbing layer is improved. The ink absorption improves due to an increase in the voids when the ratio exceeds 3.0, but opacity increased, color development declines and gloss decreases in some cases.

Furthermore, the primary particle diameter in the peanut-shaped colloidal silica is from 10 nm to 100 nm. The transparency improves when the primary particle diameter is under 10 nm, but the ink absorption declines due to a loss of voids between particles after a film is formed. When the primary particle diameter exceeds 100 nm, the opacity of the ink absorbing layer increases and the color development in recorded images declines although a suitable degree of voids is formed between particles. The decline in ink color development is particularly extensive when a pigment based ink containing colorant particles having a particle diameter of from 50 nm to 150 nm is used with an inkjet printer.

In the present invention, the colloidal silica described above and other pigments may be used in combination as the pigment in an ink absorbing layer. For example, colloidal silica present not in the range described above, synthetic silica (synthetic silica formed using a wet method, synthetic silica formed using a vapor phase method and the like), colloidal alumina, alumina ($\alpha$ type, $\gamma$ type and $\theta$ type alumina), calcium carbonate, magnesium carbonate, kaolin, talc, clay, calcium sulfate, barium sulfate, titanium dioxide, zeolite and other inorganic white pigments as well as organic pigments such as fine styrene resin particles, fine acrylic resin particles, fine urea resin particles, fine melamine resin particles and the like may be used in combination.

The proportion in which a peanut-shaped colloidal silica is used based on the total pigment in an ink absorbing layer is not restricted in the present invention, and the entire pigment may consist of the colloidal silica described above. However, in the second and fourth embodiments described later, the presence of from 5% by weight to 50% by weight of the colloidal silica mentioned above based on the total pigment is preferred and from 10% by weight to 40% by weight is more preferred. The most preferred range is from 15% by weight to 30% by weight. When the content of a peanut-shaped colloidal silica based on the total pigment is under 5% by weight, the improvement effect on ink absorption and color development when using an inkjet printer tends to be inadequate. In addition, when said colloidal silica content exceeds 50% by weight the ink absorption is good, but the color development improvement effect when using an inkjet printer declines. In addition, coating operations tend to proceed less smoothly.

(The Binder in the Ink Absorbing Layer)

The ink absorbing layer of the present invention contains at least one binder. Polymer compounds capable of forming a film can be used as the binder. For example, poly(vinyl alcohol), poly(vinyl pyrrolidone), starches such as oxidized starch, esterified starch and the like, cellulose derivatives such as carboxymethyl cellulose, hydroxyethyl cellulose and the like, water soluble resins such as casein, gelatin, soy protein and the like, urethane resins, styrene-acrylic resins, styrene-butadiene resins, acrylic resins, vinyl acetate resins, vinyl chloride resins, urea resins and alkyd resins and their derivatives may be used individually or in combinations. The content of binder is preferably from 3 parts by weight to 50 parts by weight based on 100 parts by weight of the pigment, but from 3 parts by weight to 30 parts by weight is more preferred and from 3 parts by weight to 20 parts by weight is particularly preferred. However, the content range is not particularly restricted as long as the needed strength is achieved in the coating layer. When the content of the binder is under 3 parts by weight, the coating strength may be low. When the content exceeds 50 parts by weight, the content ratio of pigment declines and the ink absorption tends to decline.

The content of a binder in an ink absorbing layer at from 3% by weight to 28% by weight is preferred, and, furthermore, from 9% by weight to 25% by weight is more preferred. When the binder content in the ink absorbing layer is too high, ink absorption tends to decline. On the contrary, when the content is too low, the strength of the ink absorbing layer tends to decline and cyan color development tends to be uneven. In addition the ratio by weight of the solids in the pigment and the binder in the ink absorbing layer expressed as (pigment)/(binder)=from 100/3 to 100/50 is preferred. When the weight ratio identified above exceeds 100/3, binder decreases which causes the film strength to decline. When the weight ratio identified above is under 100/50, pigment decreases and ink absorption tends to decline.

The polymer compounds used as the binder are preferably water based (a water soluble resin). The term "water based" signifies that a resin dissolves or disperses and is stabilized in a medium comprising water or water and a small amount of an organic solvent. These binders are dissolved to form a coating solution used to coat a base material or are dispersed as particles, but they act as a pigment binder after coating and drying to form an ink absorbing layer.

The use of poly(vinyl alcohol) as the binder is preferred due to its good transparency in a film. When poly(vinyl alcohol) is used as the binder, particularly, ink absorption and color development improves. In addition, an inkjet recording medium having excellent gloss can be obtained when an ink absorbing layer is formed using cast coating method described later. The presence of poly(vinyl alcohol) as from 50% by weight to 100% by weight of the total binder in the ink absorbing layer is preferred.

In addition, the use of casein as the binder is preferred in the present invention. When casein is added, the coating properties of a coating solution used to form an ink absorbing layer using the gelation casting method (coagulation method) described later are good. The content of from about 5% by weight to 20% by weight of casein in the ink absorbing layer is preferred. When the content of casein is little, coagulation properties and productivity tends to decline in manufacturing using a gelation casting method. When the content exceeds 20% by weight, the ink absorption of the ink absorbing layer tends to decline.

The ink absorbing layer contains the pigments and binders described above, but other components; for example, a thickener, an antifoaming agent, a foam inhibitor, a pigment dispersing agent, a mold releasing agent, a foaming agent, a pH adjusting agent, a surface sizing agent, a coloring dye, a coloring pigment, a fluorescent dye, an ultraviolet ray absorption agent, an antioxidant, a photo stabilizer, a preservative, a waterproofing agent, a dye fixing agent, a surfactant, a wet paper strengthening agent, a water retention agent, a cationic polymer electrolyte and the like may be appropriately added in a range that does not adversely affect the effects of the present invention. The total weight of the pigment and the binder in an ink absorbing layer may be at least about 90% by weight calculated in terms of the solid content.

(Coating an Ink Absorbing Layer)

An on-machine or off-machine coating method involving an appropriate device selected from well known coating machines such as blade coaters, air knife coaters, roll coaters, brush coaters, kiss coaters, squeeze coaters, curtain coaters, die coaters, bar coaters, gravure coaters, gate-roll coaters, short dowel coaters and the like may be used to, apply a coating solution to form an ink absorbing layer.

The coating weight of the ink absorbing layer can be optionally adjusted to within a range that covers a base material surface and yields adequate ink absorption. However, the range of from 5 $g/m^2$ to 30 $g/m^2$ calculated in terms of solid content per one side is preferred from the viewpoint of promoting both recorded image density and ink absorption, but from 10 $g/m^2$ to 25 $g/m^2$ is particularly preferred when productivity is also taken into consideration. When the coating weight exceeds 30 $g/m^2$, the ink absorbing layer becomes more difficult to remove from the mirror finished surface on a casting drum and problems such as the coating layer adhering to the mirror finished surface and the like may be encountered.

When a higher coating weight of an ink absorbing layer is needed in the present invention, the ink absorbing layer may be formed in many layers (or applied in many coats). In addition, an undercoating layer having ink absorption, adhesion and various other functions may be formed between a base material and an ink absorbing layer. Furthermore, a back coating layer having ink absorption, writing property, printer printing property and various other functions may also be formed on the side opposite from the side having an ink absorbing layer.

(Undercoating Layer)

When the level of ink absorption is poor and the level of ink absorption needed as an inkjet recording medium can not be achieved using only an ink absorbing layer, the formation of an undercoating layer between said base material and said ink absorbing layer having sufficient absorption capacity is preferred. The object of forming an undercoating layer is to absorb an ink or an ink solvent, and the major components are pigments and binders. Well known pigments used in ink absorbing layers such as silica, alumina, calcium carbonate, sintered clay and the like may be used individually or as a mixture as the pigments in an undercoating layer. In addition, well known binders, for example, water soluble resins such as poly(vinyl alcohol), starch and the like and emulsion resins such as ethylene-vinyl acetate copolymer resins, styrene-butadiene copolymer resins and the like may be used as a binder, In addition, sizing agents, ink fixing agents, surfactants, dyes and other well known aiding agents may be suitably added to the undercoating layer. The undercoating layer may be composed of many layers or a single layer, and, in addition, the layer may be applied many times.

From the standpoint of improving ink absorption, a pigment in the undercoating layer having an average oil absorbency of 100 ml/100 g or more is preferred.

The coating weight of an undercoating layer can be optionally adjusted to a range that covers the surface of a base material and yields adequate ink absorption properties. However, from the viewpoint of promoting both recorded image density and ink absorption, a coating weight range of from 3 $g/m^2$ to 30 $g/m^2$ in terms of solid content per one side is preferred.

(Forming an Ink Absorbing Layer Using a Cast Coating Method)

After applying a coating solution that forms an ink absorbing layer on a base material as described above in the present invention, a treatment solution that coagulates the binder (particularly an aqueous binder) in the coating solution can be applied to form a wet coating layer. Then the wet coating layer is pressed onto a heated mirror finished surface to dry the layer, to form an ink absorbing layer and to impart gloss to the surface.

This type of coating method is commonly referred to as a cast coating method. Three cast coating method types are known. (1) A wet casting method (direct method) involves pressing a wet coating layer to a heated drum having a mirror finished surface. (2) A re-wetting casting method (re-wetting method) involves drying or semi-drying a wet coating layer, wetting and plasticizing the layer using a re-wetting solution and pressing the coating layer onto a heated drum having a mirror finished surface. (3) A gelation casting method (coagulating method) involves subjecting a wet coating layer to a coagulating treatment to form a gel before pressing the layer onto a heated drum having a mirror finished surface.

In the present invention, a coating layer may be wet or dry at the point when a treatment solution is applied. When the coating layer is wet, the method corresponds to the gelation casting method described above. When the coating layer is dry, the method corresponds to the re-wetting casting method. Particularly when the coating layer is wet (in the case of a gelation casting method), a mirror finished surface is easily transferred and fine uneven features on the coating layer surface can be readily minimized to impart a gloss comparable to that of a silver halide photograph to the ink absorbing layer obtained. The treatment solution can be applied using rolls, a spray, a curtain method and the like, and no particular restriction is imposed.

Steam, electrical heating wires, induction heating coils and the like may be used as means to heat a mirror finished surface (drum) to achieve a designated temperature. The coating machine used to apply an ink absorbing layer and the like on a base material and a coating facility containing a mirror finished drum is ordinarily referred to as a casting coater.

(Treatment Solution)

Salts of calcium, zinc, magnesium, sodium, potassium, barium, lead, cadmium, ammonium and the like of formic acid, acetic acid, citric acid, tartaric acid, lactic acid, hydrochloric acid, sulfuric acid, carbonic acid and the like; borax and various borates and the like, for example, may be mentioned as the coagulating agent (a treatment solution) used in a coagulation casting method. In the present invention, at least one selected from among them can be used.

When poly(vinyl alcohol) is used as a water based binder, the use of a solution containing boric acid and a borate as the treatment solution to coagulate the poly(vinyl alcohol) is particularly preferred. A suitable degree of hardness can be readily achieved when coagulating and good gloss can be imparted to an ink absorbing layer by mixing boric acid with a borate.

A weight ratio of borate to boric acid, in terms of anhydrides, in a treatment solution of borate/boric acid of 1/4 to 2/1 is preferred. When the mixing ratio mentioned above is under 1/4, the proportion of boric acid becomes too high, the coagulation of the poly(vinyl alcohol) in the ink absorbing layer becomes inadequate, such a soft coagulating ink absorbing layer adheres to the rolls used to apply the treatment solution and a good wet ink absorbing layer is sometimes not obtained. When the mixing ratio mentioned above exceeds 2/1, the poly(vinyl alcohol) in the ink absorbing layer coagulates too hard, and difficulties may be encountered in transferring the glossy surface from a mirror finished drum surface and in obtaining good glossy surface.

The borate used in the present invention may be borax, ortho-borates, di-borates, meta-borates, penta-borates, octa-borates and the like. The borates are not particularly restricted to these examples. However, the use of borax is preferred from the standpoint of ready availability and low cost. The concentrations of borate and boric acid in a treatment solution can be adjusted appropriately as needed, but the sum of borate and boric acid concentrations in the treatment solution, in terms of anhydrides, in a range of 1% by weight to 8% by weight is preferred. When the concentrations of a borate and boric acid, particularly that of a borate, increase, poly(vinyl alcohol) coagulates too firm, and white paper brightness tends to decline. In addition, when the concentrations increase, boric acid readily precipitates from the treatment solution making the treatment solution less stable.

When casein is used as a water based binder, an aqueous solution containing various salts, such as calcium, zinc, magnesium and the like, of formic acid, acetic acid, citric acid, tartaric acid, lactic acid, hydrochloric acid, sulfuric acid and the like is used as a treatment solution that acts to coagulate the casein.

A pigment dispersing agent, a water retention agent, a thickener, an antifoaming agent, a preservative, a coloring agent, a waterproofing agent, a wetting agent, a fluorescent dye, an ultraviolet ray absorption agent, a cationic polymer electrolyte and the like may be appropriately added to the treatment solution as needed.

In addition, the method to apply a treatment solution onto an ink absorbing layer (a coating layer prior to a cast treatment) is not particularly restricted and may be appropriately selected from among well known methods (for example, rolls, sprays, curtain methods and the like).

Furthermore, a releasing agent may also be added to the coating solution and to the treatment solution for an ink absorbing layer in order to make removing the ink absorbing layer from a mirror finished drum easier. The melting point of the releasing agent is preferably from 90° C. to 150° C., and from 95° C. to 120° C. is particularly preferred. A releasing agent melting point in the range specified above is almost identical to the temperature of the mirror finished metal surface, and the performance of the releasing agent is maximized. The releasing agent is not particularly restricted as long as it has the properties described above. A polyethylene type wax emulsion is particularly preferred as the releasing agent.

(Gloss)

75 degree specular gloss measurement for the ink absorbing layer surface of the inkjet recording medium in the present embodiment of 50% or more is preferred since a gloss comparable to that of a silver halide photograph can then be achieved. Furthermore, image clarity measurement of 20% or more for the ink absorbing layer surface may yielded a more preferred gloss 0.75 degree specular gloss measurement is performed according to JIS-P-8142, and image clarity measurement is performed according to JIS-K-7105.

Next, preferred embodiments of the present invention are shown as examples.

(1) First Embodiment

<An Embodiment in which the Ink Absorbing Layer Contains a Colloidal Silica and a Silica Formed Using a Vapor Phase Method>

In this embodiment, an ink absorbing layer containing a colloidal silica having a primary particle diameter of from 10 nm to 50 nm and a silica formed using a vapor phase method having a specific surface area of from 130 $m^2/g$ to 300 $m^2/g$ is formed on the base material surface. Image color development is particularly exceptional in the present embodiment because ink absorption and transparency of the ink absorbing layer is improved.

(Pigment in the Ink Absorbing Layer)

Ink absorption is improved by containing a colloidal silica and a silica formed using a vapor phase method as pigments. In addition, the transparency of the ink absorbing layer is excellent, the size of cracks forming on the ink absorbing layer surface is small, and, as a result, the optical density (image color developments is improved by having the pigment composed in this manner in the ink absorbing layer.

A silica formed using a vapor phase method is also referred to as a silica formed using a dry method or a fumed silica and is generally formed using a flame hydrolysis method. A silica formed using a vapor phase method is specifically formed using a volatile silane compound such as silicon tetrachloride that is allowed to undergo a vapor phase hydrolysis in an oxygen hydrogen flame, and a product having designated properties can be obtained by changing conditions such as flame temperature, the supply ratio of oxygen and hydrogen, silicon tetrachloride as raw material supply content and the like. Silanes such as methyl trichlorosilane, trichlorosilane and the like, individually or in the form of a mixture with silicon tetrachloride, may be used in place of the silicon tetrachloride. Silicas formed using a vapor phase method are available as AEROSIL from NIPPON AEROSIL CO., LTD. and as Reolosil QS Type from Tokuyama Corp. An average primary particle diameter of from 5 nm to 50 nm is preferred for silica formed using a vapor phase method.

The specific surface area (BET method) of said silica formed using a vapor phase method is from 130 $m^2/g$ to 300 $m^2/g$. The transparency of the ink absorbing layer increases, and the stability when said silica is added to a coating improves. When the specific surface area is under 130 $m^2/g$, deficiencies such as the increasing opacity of the ink absorbing layer and declining optical density may be encountered. When the specific surface area exceeds 300 $m^2/g$, the transparency of the ink absorbing layer is good and optical density improves but the coating stability tends to decline.

A colloidal silica having the peanut-shape described above and having a primary particle diameter of from 10 nm to 50 nm is used. When the primary particle diameter is under 10 nm, the transparency is excellent but the ink absorption tends to decline due to the loss of voids between particles. Similarly, when the primary particle diameter exceeds 50 nm, the voids between particles are preserved but transparency decreases, and the color development tends to decline on inkjet recording. A decline in ink color development may be particularly pronounced when a pigment ink contains coloring particles having a particle diameter of from 50 nm to 150 nm.

Preferred proportions of colloidal silica and silica formed using a vapor phase method, (colloidal silica)/(vapor phase silica), are in the range of from 45/55 to 95/5, and the range of from 60/40 to 80/20 is more preferred. When the proportion of colloidal silica is too high, the transparency of the coating layer and the optical density improve, but ink absorption properties tend to decline. Conversely, when the proportion of colloidal silica is too low ink absorption is good, but the gloss tends to decline.

At least one well known white pigment may also be added in a range in which the effects (ink absorption, gloss, color development and the like) of the present embodiment are not adversely affected. For example, inorganic white pigments such as synthetic non-crystalline silica, colloidal silica, alumina, colloidal alumina, pseudo boehmite, aluminum hydroxide, light (precipitated) calcium carbonate, heavy calcium carbonate, magnesium carbonate, kaolin, talc, calcium sulfate, barium sulfate, titanium dioxide, zinc oxide, zinc sulfide, zinc carbonate, satin white, aluminum silicate, diatomaceous earth, calcium silicate, magnesium silicate, lithopone, zeolite, hydrated halloysite, magnesium hydroxide and the like and organic pigments such as styrene type plastic pigments, acrylic type plastic pigments, polyethylene, microcapsules, urea resins, melamine resins and the like may be used in combination.

The proportion of colloidal silica content based on the total pigment in an ink absorbing layer may be within the range mentioned above (the pigment may comprise only colloidal silica and a silica formed using a vapor phase method).

As the binder, those mentioned above may be used.

(2) Second Embodiment

<An Embodiment in which the Ink Absorbing Layer Contains Colloidal Silica and γ Type Alumina>

In this embodiment, an ink absorbing layer containing a colloidal silica having a primary particle diameter of from 10 nm to 50 nm and γ type alumina is formed on the base material surface. In this embodiment, the image color development is particularly exceptional because ink absorption and transparency of the ink absorbing layer is improved.

(The Pigment in the Ink absorbing layer)

Ink absorption is improved by containing colloidal silica and γ type alumina as the pigments in an ink absorbing layer.

The γ type alumina (γ type crystalline alumina) can be obtained by heating and burning pseudo boehmite or boehmite formed using a well known method at 400° C. to 900° C. A γ type crystalline alumina formed in the manner described above can be ground and classified to adjust it to a desired particle diameter and a particle diameter distribution range. An average particle diameter of from 1.0 μm to 3.5 μm is preferred for the γ type alumina since the ink absorbing layer needs to transfer a mirror finished surface from a heated mirror finished surface drum (to smooth the surface of the layer).

The colloidal silica is shaped like peanuts as described above, and those having a primary particle diameter of from 10 nm to 50 nm are used. A preferred primary particle diameter is from 13 nm to 40 nm. When the primary particle diameter is under 10 nm, transparency is excellent but the voids between particles are lost, and ink absorption tends to decline. On the other hand, when the primary particle diameter exceeds 50 nm the voids between particles are preserved, but transparency declines and color development when inkjet recording tends to decline. Particularly, ink color development may decrease noticeably when a pigment ink containing coloring particles having a particle diameter of from 50 nm to 150 nm is used.

The ratio of the secondary particle diameter to the primary particle diameter (secondary particle diameter/primary particle diameter) in the colloidal silica is preferably 1.5-2.5.

The proportion of the content of the γ type alumina and the colloidal silica mentioned above is preferably in a range of from 95/5 to 50/50 (γ type alumina)/(colloidal silica), but a range of from 90/10 to 60/40 is more preferred.

At least one well-known, white pigment may also be added in a range in which the effects (ink absorption, gloss, color development and the like) of the present embodiment are not adversely affected. For example, inorganic white pigments such as synthetic non-crystalline silica, colloidal silica, alumina, colloidal alumina, pseudo boehmite, aluminum hydroxide, precipitated calcium carbonate, ground calcium carbonate, magnesium carbonate, kaolin, talc, calcium sulfate, barium sulfate, titanium dioxide, zinc oxide, zinc sulfite, zinc carbonate, satin white, aluminum silicate, diatomaceous earth, calcium silicate, magnesium silicate, lithopone, zeolite, hydrated halloysite, magnesium hydroxide and the like as well as organic pigments such as styrene type plastic pigments, acrylic type plastic pigments, polyethylene, microcapsules, urea resins, melamine resins and the like may be used in combination.

The proportion of a colloidal silica content based on the total pigment in an ink absorbing layer may be within the range mentioned above.

As a binder, those men mentioned above may be used.

(3) Third Embodiment

<An Embodiment in which an Undercoating Layer is Formed Between an Ink Absorbing Layer and a Base Material>

In this embodiment, an undercoating layer is formed between an ink absorbing layer and a base material; and the total amount of the colloidal silica and the water soluble resin in the ink absorbing layer is 90% or more by weight in terms of the solid content. In this embodiment, image color development is particularly excellent because transparency of the ink absorbing layer is improved.

(Ink Absorbing Layer)

In order to improve the transparency of an ink absorbing layer, the total amount of the colloidal silica and the water soluble resin in the ink absorbing layer should be 90% or more by weight in terms of the solid content. Preferably, the total amount mentioned above is 95% or more by weight, and the total amount mentioned above may also be 100% by weight.

(The Pigment in an Ink Absorbing Layer)

When powder particles having a large particle diameter (refers to an average particle diameter of about several micrometers) such as silica, alumina, calcium carbonate, burned clay and the like are contained as the pigment in an ink absorbing layer, the transparency in the ink absorbing layer is adversely affected and recorded image clarity tends to decline. Therefore, the content of 90% or more by weight of the (peanut-shaped) colloidal silica mentioned above per total pigment in the ink absorbing layer is preferred, and 95% or more by weight is much preferred. By using colloidal silica, the transparency and gloss of the ink absorbing layer can be improved.

In addition, transparency is excellent but the voids between particles are lost and the ink absorption tends to decline when the average primary particle diameter of colloidal silica is under 13 nm. Similarly, when the average primary particle diameter of said colloidal silica exceeds 40 nm, the voids between particles are preserved, but the transparency decreases, and color development tends to decline. Particularly, ink color development may decrease noticeably when a pigment ink containing particles having a particle diameter of from 50 nm to 150 nm is used. Therefore, an average primary particle diameter of 10 nm to 40 nm for the colloidal silica is preferred.

(Ink Absorbing Layer Binder)

Binders used to improve the transparency of an ink absorbing layer are mainly water soluble resins. The use of poly (vinyl alcohol) and/or a derivative of poly(vinyl alcohol) as the binder is preferred. In addition, for the object mentioned above, the concentration of a binder other than a water soluble resin is desirably as low as possible The content of 10% or less by weight of a binder other than a water soluble resin on total binder in an ink absorbing layer is preferred, and 5% or less by weight is more preferred. The proportion of a binder to a pigment in the range previously mentioned is acceptable. In addition, a solid content weight ratio for the pigment and the binder for an ink absorbing layer that satisfies the relationship of (pigment)/(binder)=100/3 to 100/50 is preferred.

(Undercoating Layer)

In this embodiment, ink absorption is not necessarily excellent although the ink absorbing layer has excellent transparency. Therefore, an undercoating layer having excellent ink absorption is formed. As the undercoating layer, those mentioned above may be used. The oil absorbency of the pigments used may be in the range described above.

A low coating weight for an ink absorbing layer is preferred from the standpoint of improving the transparency of the ink absorbing layer and improving productivity by raising the coating speed. However, in such a case, desirably the undercoating layer itself has some degree of inkjet adaptability (more specifically, a fast ink drying speed, good optical density and absence of ink blurring or bleeding).

The coating weight of the undercoating layer may be within the range mentioned above, but a more preferred range is from 10 g/m$^2$ to 30 g/m$^2$. When the coating weight exceeds 30 g/m$^2$, the undercoating layer becomes weak due to vapor generated during cast coating, and problem that, the coating layer including the undercoating layer adheres to the mirror finished surface of a casting drum may occur.

To increase the coating weight of an undercoating layer, many layers of the undercoating layer may be formed by applying the coating multiple times. When an undercoating layer consists of many layers, the total coating weight for the individual layers in the range specified above is desirable.

(4) Fourth Embodiment

<An Embodiment in which Colloidal Silica and Synthetic Non-crystalline Silica are Contained in an Ink Absorbing Layer>

In this embodiment an ink absorbing layer is formed containing a colloidal silica having a primary particle diameter of from 30 nm to 100 nm and a ratio of a secondary particle diameter to said primary particle diameter of from 1.5 to 2.5 and a synthetic non-crystalline silica formed using a wet method as pigments on a base material surface. In this embodiment, image color development is particularly excellent, and uneven printing is effectively prevented. Here, uneven printing refers to uneven dark and light areas generated when an inkjet recording method is used to print a solid image. The uneven printing is more likely to occur particularly when a cyan color is used.

(Pigment in an Ink Absorbing Layer)

When a synthetic non-crystalline silica formed using a wet method is used, the color development properties can be improved. In addition, adequate ink absorption can be obtained without forming an undercoating layer.

In addition, the primary particle diameter of the colloidal silica mentioned above is from 30 nm to 100 nm and is preferably from 50 nm to 75 nm while the ratio of a secondary particle diameter to the primary particle diameter is from 1.5 to 2.5. When the primary particle diameter is under 30 nm, the transparency of the ink absorbing layer is excellent but the ink absorption declines due to the loss of voids between particles. When the primary particle diameter exceeds 100 nm, the ink absorption is good due to increased gaps between particles but the color development declines due to increase of opacity. Particularly, ink color development is significantly decreases when a pigment ink containing coloring particles having a particle diameter of from 50 nm to 150 nm is used.

When this colloidal silica is used as a pigment, uneven printing (particularly when a cyan color is used) can be effectively reduced. The reason for this is not clearly understood, but the following reason is proposed. That is, cracks are ordinarily formed on the surface of a coating layer formed using a cast coating method. Ink is selectively absorbed by these cracks creating a difference in the color density between the areas having cracks and those having no cracks. On the other hand, when a colloidal silica mentioned above is contained in an ink absorbing layer, individual cracks become smaller, and the number of cracks simultaneously increases. As a result, the cracks are thought to be evenly distributed over the layer surface, difference in the density between cracked areas and uncracked areas become smaller and uneven printing declines.

The preferred range of the proportion of the synthetic non-crystalline silica and colloidal silica content is from 95/5 to 50/50 for (synthetic non crystalline silica)/(colloidal silica), and the range of from 90/10 to 60/40 is more preferred.

As the pigment, other pigments such as, for example, aluminum hydroxide, alumina sol, colloidal alumina, alumina ($\alpha$-type crystalline alumina, $\theta$-type crystalline alumina, $\gamma$-type crystalline alumina and the like) such as pseudo boehmite and the like, hydrated alumina, synthetic silica, kaolin, talc, calcium carbonate, titanium dioxide, clay, zinc oxide and the like may also be used in combination.

The proportion of colloidal silica content relative to the total amount of pigment in an ink absorbing layer should be in the range described above.

As a binder, those mentioned above can be used. The presence of casein in the binder is particularly effective in the present invention since the cracks described above tend to be formed easily.

EXAMPLES

The present invention is explained in further, detail by presenting, specific examples below, but the present invention is not limited by these examples. In addition, the terms "parts" and "%" described below refer to "parts by weight" and "% unless otherwise noted.

Experiment 1: An Experimental Example of the First Embodiment

Example 1

(Production of a Base Material)

Ten parts of talc, 1.0 part of aluminum sulfate, 0.1 part of a synthetic sizing agent and 0.02 part of a yield improving agent were added to a pulp slurry comprising 100 parts of a bleached hard wood kraft pulp (L-BKP) having a degree of beating of 285 ml. The slurry was formed into paper as a base material using a paper machine, then starch was applied on both sides of the base material at a solid content of 2.5 g/m$^2$ per side to obtain a stock paper weighing 170 g/m$^2$.

(Forming an Undercoating Layer)

A blade coater was used to apply coating solution A described below at a coating weight of 8 g/m$^2$ on one side of this stock paper, and the coating was air dried at 140° C. to form an undercoating layer.

Coating solution A: 100 parts of synthetic silica (Finesil X-37, Tokuyama Corp.) as the pigment, 5 parts of a latex (LX438C: a trade name of Sumitomo Chemical Company, Ltd.), 24 parts of poly(vinyl alcohol) (PVA117: a trade name of Kuraray Co., LTD.) as the binder, and 5 parts of a sizing agent (Polymaron 360: a trade name of Arakawa Chemical Industries, Ltd.) were mixed to prepare an aqueous coating solution having a concentration of 20%.

(Forming an Ink Absorbing Layer)

Next, a roll coater was used to apply the coating solution B3 described below at a coating weight of 20 g/m$^2$ on the surface coated with the coating solution A. While the coated layer was wet, a coagulation solution C3 was used to coagulate the layer. A press roll was used to press the coated layer onto a heated mirror finished surface to transfer the mirror finished surface, and a cast coated paper for inkjet recording of 198 g/m$^2$ was obtained.

Coating solution B3: 50 parts of a colloidal silica (Quartron PL-1: a trade name of Fuso Chemical Co., Ltd.) having an average primary particle diameter of 15 nm and 50 parts of a silica formed using a vapor phase method (AEROSIL 130: a trade name of NIPPON AEROSIL CO., LTD.) were used as pigments, 5 parts of poly(vinyl alcohol) (PVA 235: a trade name of Kuraray Co., LTD . . . ) having a degree of polymerization of 3,500 was used as the binder and 0.2 part of an antifoaming agent were added to prepare a coating solution having a concentration of 20%.

Coagulation solution C3: A mixture of 2% borax, 2% boric acid and 0.2% of a mold releasing agent (FL-48C: Toho. Chemical Industry. Co., Ltd.) were mixed to prepare a coagulation solution. The ratio by weight of borax and boric acid used (borax/boric acid) was 1/1. The concentration identified above was calculated in terms of $Na_2B_4O_7$ for borax and $H_3BO_3$ for boric acid.

Example 2

A cast coated paper for inkjet recording was obtained in the manner described in Example 1 with the exception that the coating solution B31, described below, was used in place of the coating solution B3.

Coating solution B31: 70 parts of a colloidal silica (Quartron PL-2: a trade name of Fuso Chemical Co., Ltd.) having an average primary particle diameter of 23 nm and 30 parts of a silica formed using a vapor phase method (AEROSIL 200V: NIPPON AEROSIL CO., LTD.) were used as pigments. 10 parts of poly(vinyl alcohol) (MA26GP: a trade name of Shin-Etsu Chemical Co. Ltd.) having a degree of polymerization of 2,600 was used as the binder, and 0.2 part of an antifoaming agent was also added to prepare a coating solution B31 having a concentration of 22%.

Example 3

A cast coated paper for inkjet recording was obtained in the manner described in Example 2 with the exception that 20 parts of a poly(vinyl alcohol) (PVA617: a trade name of Kuraray Co., LTD.) having a degree of polymerization of 1,700 was used in place of the binder mentioned above in the coating solution B31.

Example 4

A cast coated paper for inkjet recording was obtained in the manner described in Example 2 with the exception that the amount of the colloidal silica was changed to 60 parts and the amount of the silica formed using a vapor phase method was changed to 40 parts, in addition, 15 parts of poly(vinyl alcohol) (PVA105: a trade name of Kuraray Co., LTD.) having a degree of polymerizaton of 500 and 15 parts of a poly(vinyl alcohol) (MA26GP: a trade name of Shin-Etsu Chemical Co., Ltd.) having a degree of polymerization of 2,600 in combination were used in place of said binder to prepare a coating solution having a concentration of 24% in the coating solution B31.

Example 5

A cast coated paper for inkjet recording was obtained in the manner described in. Example 1 with the exception that the coating solution B32-described below was used, in place of the coating solution B3.

Coating solution B32: As the pigment, 95 parts of a colloidal silica (Quartron PL-2: a trade name of Fuso Chemical Co., Ltd.) having an average primary particle diameter of 23 nm and 0.5 parts of a silica formed using a vapor phase method (AEROSIL 300: NIPPON AEROSIL CO., LTD.) having a specific surface area of 300 m$^2$/g were used, as the binder, 0.5 parts of poly(vinyl alcohol) (MA26GP: a trade name of Shin-Etsu Chemical Co., Ltd.) having a degree of polymerization of 2,600 was, used, and furthermore, 0.2 part of an antifoaming agent was added to prepare a coating solution having a concentration of 20%.

Example 6

A cast coated paper for inkjet recording was obtained in the manner described in Example 1 with the exception that the coating solution B33 described below in place of the coating solution B3.

Coating solution B33: As the pigment, 50 parts of a colloidal silica (Quartron PL-2: a trade name of Fuso Chemical Co., Ltd.) having an average primary particle diameter of 23 nm and 50 parts of a silica formed using a vapor phase method (Reolosil QS-102: Tokuyama Co.) having a specific surface area of 200 m$^2$/g were used. As the binder, 15 parts of poly (vinyl alcohol) (PVA105: a trade name of Kuraray Co., LTD.) having a degree of polymerization of 500 and 15 parts poly (vinyl alcohol) (MA26GP: a trade name of Shin-Etsu Chemical Co., Ltd.) having a degree of polymerization of 2,600 were used in combination. Furthermore, 0.2 part of an antifoaming agent was added to prepare a coating solution having a concentration of 24%.

Example 7

A cast coated paper for inkjet recording was obtained in the manner described in Example 6 with the exception that the amount of the colloidal silica was changed to 70 parts and the amount of the silica formed using a vapor phase method was changed to 30 parts, in addition, 20 parts of poly(vinyl alcohol) (PVA617: a trade name of Kuraray Co., LTD.) having a degree of polymerization of 1,700 in place of the binder was added to prepare a coating solution having a concentration of 22% in the coating solution B33.

Example 8

A cast coated paper for inkjet recording of 195 g/m$^2$ was obtained in the manner described in Example 1 with the exception of not applying an undercoating layer and applying the coating solution B34 described below at a coating weight of 0.25 g/m$^2$ in place of the coating solution B3.

Coating solution B34: As the pigment, 50 parts of a colloidal silica (Quartron PL-3: a trade name of Fuso Chemical Co., Ltd.) having an average primary particle diameter of 35 nm and 50 parts of a silica formed using a vapor phase method (AEROSIL 300: NIPPON AEROSIL CO., LTD.) having a specific surface area of 300 $m^2/g$ were used. As the binder, 35 parts of poly(vinyl alcohol) (PVA105: a trade name of Kuraray Co., LTD.) having a degree of polymerization of 500 was added, and 0.2 part of an antifoaming agent was added to prepare a coating solution having a concentration of 22%.

Example 9

A cast coated paper for inkjet recording was obtained in the manner described in Example 2 with the exception that the amount of the binder was changed to 3 parts to prepare a coating solution having a concentration of 23% in the coating solution B31.

Example 10

A cast coated paper for inkjet recording was obtained in the manner described in Example 6 with the exception that the amount of the colloidal silica was changed to 70 parts and the amount of the silica formed using a vapor phase method changed to 30 parts, and 40 parts of poly(vinyl alcohol) (PVA105: a trade name of Kuraray Co., LTD.) having a degree of polymerization of 500 in place of the binder was added to prepare a coating solution having a concentration of 24% in the coating solution B33.

Comparative Example 1

A cast coated paper for inkjet recording was obtained in the manner described in Example 2 with the exception that the colloidal silica was not used, and the amount of the silica formed using a vapor phase method was changed to 100 parts to prepare a coating solution having a concentration of 12% in the coating solution B31.

Comparative Example 2

A cast coated paper for inkjet recording was obtained in the manner described in Example 6 with the exception that 70 parts of string of pearl (bead) shaped colloidal silica (Snowtex ST-PS-M: a trade name of Nissan Chemical Industries, Ltd.) having an average primary particle diameter of 18 nm to 25 nm was added in place of the colloidal silica mentioned, above, and the amount of the silica formed using a vapor phase method was changed to 30 parts, and adding 10 parts of poly(vinyl alcohol) (MA26GP: a trade name of Shin-Etsu Chemical Co., Ltd.) having a degree of polymerization of 2,600 in place of the binder mentioned above to prepare a coating solution having a concentration of 22% in the coating solution B33.

Comparative Example 3

A cast coated paper for inkjet recording was obtained in the manner described in Comparative Example 2 with the exception that 70 parts of cluster shaped colloidal silica (Snowtex ST-HS-M20: a trade name of Nissan Chemical Industries, Ltd.) having an average primary particle diameter of 25 nm was added in place of the colloidal silica mentioned above in the coating solution B33.

Comparative Example 4

A cast coated paper for inkjet recording was obtained in the manner described in Comparative Example 2 with the exception that 70 parts, of a spherical colloidal silica (Snowtex ST-30: a trade name of Nissan. Chemical Industries, Ltd.) having an average primary particle diameter of 10 nm to 20 nm was added in place of the colloidal silica mentioned above in the coating solution B33.

(Evaluation)

The cast coated paper for inkjet recording obtained in individual examples and comparative examples were evaluated according to the methods described below.

(1) Gloss

The gloss was evaluated according to the method described below. First, 75 degree specular gloss of the surface of the ink absorbing layer was measured according to JIS P8142 using a gloss meter (Murakami Color Research Laboratory, True GLOSS GM-26PRO). Next, the image clarity of the surface of the ink absorbing layer was measured in the MD direction of the paper according to JIS K7105 using an image clarity meter (Model ICM-1DP, Suga Test instruments Co., Ltd.) at a measuring angle of 60 degree and a grating width of 2 mm. The following standards were applied based on the evaluation results.

○: At least 50% in 75 degree specular gloss and at least 40% in image clarity.

Δ: At least 50% in 75 degree specular gloss and 20% to 40% in image clarity

X: At least 50% in 75 degree specular gloss and 20% or less in image clarity (2) Inkjet Recording Test.

Cases in which a dye ink and a pigment ink were used were evaluated individually. The following pattern was recorded using one inkjet printer (PM-950C: a trade name of Seiko Epson Corp.) in cases when a dye ink was used, and the results were evaluated according to the following standards. In cases when a pigment ink was used, another inkjet printer (PM-4000PX: a trade name of Seiko Epson Corp.) was used for similar evaluations.

2-1. Ink Absorption (Bleeding).

The bleeding along a boundary between red and green in solid images adjacent to each other was visually evaluated.

○: The color boundary area was clearly identified.

Δ: Some bleeding was observed along the boundary.

X: Severe bleeding was observed along the boundary.

2-2. Image Clarity.

Image clarity of designated recording image was visually evaluated.

◎: Very clear.

○: Clear.

Δ: Image clarity was slightly inferior.

X: No image clarity.

The dispersed colloidal silica particle diameter in coating solutions B3-B34 was measured using the method described below. The primary particle diameter was calculated by obtaining the specific surface area according to a nitrogen adsorption method and using the equation (1) shown below.

$$\text{Specific surface area } S=4\pi r^2/((4\pi r^3/3)\times\rho \quad (1)$$

[In the equation, ρ is the true specific gravity of silica (2.2 $g/cm^3$), r is a primary particle diameter (nm) and S: represents specific surface-area S ($m^2/g$).]

The secondary particle diameter of colloidal silica was measured using a ZETASIZER 3000HSA of Malvern Instruments.

The results obtained are shown in Table 1.

TABLE 1

| | Ink absorbing layer | | | | | | | | |
|---|---|---|---|---|---|---|---|---|---|
| | Pigment | | | | | | | | |
| | Colloidal silica | | | | | Vapor phase silica | | Number of | Amount |
| | Trade name | Shape | Primary particle diameter (nm) | Secondary particle diameter (nm) | Secondary particle diameter/primary particle diameter | Trade name | Specific surface area ($m^2/g$) | parts added (colloidal sllica/vapor phase silica) | of binder added (parts by weight) |
| Example. 1 | PL-1 | Peanut-shaped | 15 | 40 | 2.7 | AEROSIL 130 | 130 | 50/50 | 5 |
| Example. 2 | PL-2 | Peanut-shaped | 23 | 51 | 2.2 | AEROSIL 200V | 200 | 70/30 | 10 |
| Example. 3 | PL-2 | Peanut-shaped | 23 | 51 | 2.2 | AEROSIL 200V | 200 | 70/30 | 20 |
| Example. 4 | PL-2 | Peanut-shaped | 23 | 51 | 2.2 | AEROSIL 200V | 200 | 60/40 | 30 |
| Example. 5 | PL-2 | Peanut-shaped | 23 | 51 | 2.2 | AEROSIL 300 | 300 | 95/5 | 5 |
| Example. 6 | PL-2 | Peanut-shaped | 23 | 51 | 2.2 | Reolosil QS-102 | 200 | 50/50 | 30 |
| Example. 7 | PL-2 | Peanut-shaped | 23 | 51 | 2.2 | Reolosil QS-102 | 200 | 70/30 | 20 |
| Example. 8 | PL-3 | Peanut-shaped | 35 | 70 | 2.0 | AEROSIL 300 | 300 | 50/50 | 35 |
| Example. 9 | PL-2 | Peanut-shaped | 23 | 51 | 2.2 | AEROSIL 200V | 200 | 70/30 | 3 |
| Example. 10 | PL-2 | Peanut-shaped | 23 | 51 | 2.2 | Reolosil QS-102 | 200 | 70/30 | 40 |
| Comp. Ex. 1 | — | — | — | — | — | AEROSIL 200V | 200 | 0/100 | 10 |
| Comp. Ex. 2 | ST-PS-M | Bead shaped | 18-25 | 100-200 | 5.5-8.0 | Reolosil QS-102 | 200 | 70/30 | 10 |
| Comp. Ex. 3 | ST-HS-M20 | Cluster shaped | 25 | 278 | 11.1 | Reolosil QS-102 | 200 | 70/30 | 10 |
| Comp. Ex. 4 | ST-30 | Spherical | 10-20 | 10-20 | 1.0 | Reolosil QS-102 | 200 | 70/30 | 10 |

| | | Evaluation | | | | |
|---|---|---|---|---|---|---|
| | Under | | Ink absorption | | Image clarity | |
| | coating layer | Gloss | Dye ink | Pigment ink | Dye ink | Pigment ink |
| Example. 1 | Present | ○ | ○ | ○ | ○ | ○ |
| Example. 2 | Present | ○ | ○ | ○ | ○ | ⊙ |
| Example. 3 | Present | ○ | ○ | ○ | ○ | ⊙ |
| Example. 4 | Present | ○ | ○ | ○ | ○ | ⊙ |
| Example. 5 | Present | ○ | ○ | ○ | ○ | ○ |
| Example. 6 | Present | ○ | ○ | ○ | ○ | ⊙ |
| Example. 7 | Present | ○ | ○ | ○ | ○ | ⊙ |
| Example. 8 | — | ○ | ○ | Δ-○ | ○ | ○ |
| Example. 9 | Present | Δ | ○ | ○ | ○ | Δ |
| Example. 10 | Present | ○ | Δ | Δ | ○ | Δ |
| Comp. Ex. 1 | Present | X | Δ | Δ | ○ | Δ |
| Comp. Ex. 2 | Present | Δ | ○ | ○ | X | Δ |
| Comp. Ex. 3 | Present | X | ○ | ○ | X | Δ |
| Comp. Ex. 4 | Present | ○ | X | X | ○ | X |

As is clearly indicated by the data presented in Table 1, the inkjet recording quality was good in the examples regardless of whether a dye ink or a pigment ink was used. In addition, gloss comparable to that of a silver halide photograph was obtained. Also, the operations during casting coating proceeded exceptionally well.

When colloidal silica was not added to the pigment in the ink absorbing layer as in the case of Comparative Example 1, gloss was significantly reduced. In addition, when a string of pearl or cluster shaped colloidal silica was used as the colloidal silica in Comparative Examples 2 and 3, image clarity achieved when using a dye ink was extensively reduced. In the case of Comparative Example 4 when a spherical colloidal silica that did not coagulate and had a ratio of secondary particle diameter to primary particle diameter of under 1.5 was used, ink absorption and image clarity which is associated with the use of pigment ink declined extensively.

Experiment 2: An Experimental Example of the Second Embodiment

Example 11

(Manufacturing a Base Material)

A stock paper weighing 170 $g/m^2$ was obtained in the same manner described in Experiment 1. However, the coating weight of starch per side of the base material was 1.5 $g/m^2$ at a solid content.

(Forming an Undercoating Layer)

An undercoating layer was formed in the same manner described in Experiment 1.

(Forming an Ink Absorbing Layer)

Next, a roll coater was used to apply the coating solution B2, described below at a coating weight of 23 g/m$^2$ on the surface coated with the coating solution A. While the coated layer was wet, a coagulating solution C as described below was used to coagulate the layer. A press roll was used next to press the coated layer onto a heated mirror finished surface to transfer the mirror finished surface, and a cast coated paper for inkjet recording weighing 200 g/m$^2$ was obtained.

Coating solution B2: 70 parts of γ-alumina (AKP-G015: a trade name of Sumitomo Chemical Company, Ltd.) having a particle diameter of 2.4 μm and 30 parts of colloidal silica (Quartron PL1: a trade name of Fuso Chemical Co., Ltd.) having an average primary particle diameter of 14 nm as pigments, a total of 10 parts of poly(vinyl alcohol) A (Kuraray 224: a trade name of Kuraray Co., LTD.) having a degree of polymerization of 2,400 and poly(vinyl alcohol) B (MA26GP a trade name of Shin-Etsu Chemical Co., Ltd.) having a degree of polymerization of 2,600 (combination ratio by weight was 1:1) as the binder, 5 parts of a cationic polyurethane (F8570 D2: a trade name of Dai-ichi Kogyo Seiyaku. Co., Ltd.), 3 parts of an ink fixing agent (Saftomer ST3300: formed by Mitsubishi Chemical Corporation.) and 0.2 part of an antifoaming agent were added to prepare a coating solution having a concentration of 28%.

Coagulating solution C: A mixture of borax and boric acid in a total concentration of 4%, and 0.2% of a mold releasing agent (FL-48C: Toho Chemical Industry. Co., Ltd.) were mixed to prepare a coagulating solution. The combination ratio (borax/boric acid) by weight was 1/4, and the total concentration referenced above was calculated in terms of borax being $Na_2B_4O_7$ and boric acid being $H_3BO_3$.

Example 12

A cast coated paper for inkjet recording was obtained in the manner described in Example 11 with the exception that 30 parts of colloidal silica (Quartron PL2: a trade name of Fuso Chemical Co., Ltd.) having an average primary particle diameter of 23 nm was added to the coating solution B2 in place of the colloidal silica mentioned above.

Example 13

A cast coated paper for inkjet recording was obtained in the manner described in Example 11 with the exception that 30 parts of colloidal silica (Quartron PL3: a trade name of Fuso Chemical Co., Ltd.) having an average primary particle diameter of 35 nm was added to the coating solution B2 in place of the colloidal silica described above.

Example 14

A cast coated paper for inkjet recording was obtained in the manner described in Example 12 with the exception that the amount of γ-alumina was 95 parts and the amount of colloidal silica was 5 parts in the coating solution B2.

Example 15

A cast coated paper for inkjet recording was obtained in the manner described in Example 12 with the exception that the amount of γ-alumina was 85 parts and the amount of colloidal silica was 15 parts in the coating solution B2.

Example 16

A cast coated paper for inkjet recording was obtained in the manner described in Example 12 with the exception that the amount of γ-alumina was 50 parts and the amount of colloidal silica was 50 parts in the coating solution B2.

Example 17

A cast coated paper for inkjet recording was obtained in the manner described in Example 12 with the exception that the undercoating layer was not formed and the coating weight of the coating solution B2 was 30 g/m$^2$.

Comparative Example 5

A cast coated paper for inkjet recording was obtained in the manner described in Example 11 with the exception that the amount of γ-alumina was 100 parts and colloidal silica was not added to prepare the coating solution B2.

Comparative Example 6

A cast coated paper for inkjet recording was obtained in the manner described in Example 11 with the exception that a chain shaped colloidal silica (ST-UP: a trade name of Nissan Chemical Industries, Ltd.) having an average primary particle diameter of 12.5 nm was added in place of the colloidal silica mentioned above to prepare the coating solution B2.

Comparative Example 7

A cast coated paper for inkjet recording was obtained in the manner described in Example 11 with the exception that a spherical colloidal silica (Snowtex AK: a trade name of Nissan Chemical Industries, Ltd., single silica that is not aggregated) having an average primary particle diameter of 15 nm was added in place of the colloidal silica mentioned above to prepare the coating solution B2.

(Evaluations)

The cast coated paper for inkjet recording obtained in: individual examples and comparative examples were evaluated according to the same methods used in Experiment 1. The secondary particle diameter of dispersed colloidal silica of the coating solution B2 was measured using a ZETASIZER 3000HSA by Malvern Instruments Ltd.

The results obtained are shown in Table 2.

TABLE 2

| | Ink absorbing layer | | | | | | | | |
|---|---|---|---|---|---|---|---|---|---|
| | Pigment | | | | | | | | |
| | Colloidal silica | | | | | γ-Alumina | | Number of parts added | |
| | Trade name | Shape | Primary particle diameter (nm) | Secondary particle diameter (nm) | Secondary particle diameter/primary particle diameter | Trade name | Particle diameter (μm) | (γ alumina/colloidal silica) | Binder |
| Example 11 | PL-1 | Peanut-shaped | 14 | 33 | 2.3 | AKP-G015 | 2.4 | 70/30 | 10 parts PVA and 5 parts polyurethane |
| Example 12 | PL-2 | Peanut-shaped | 23 | 51 | 2.2 | AKP-G015 | 2.4 | 70/30 | 10 parts PVA and 5 parts polyurethane |
| Example 13 | PL-3 | Peanut-shaped | 35 | 70 | 2.0 | AKP-G015 | 2.4 | 70/30 | 10 parts PVA and 5 parts polyurethane |
| Example 14 | PL-2 | Peanut-shaped | 23 | 51 | 2.2 | AKP-G015 | 2.4 | 95/5 | 10 parts PVA and 5 parts polyurethane |
| Example 15 | PL-2 | Peanut-shaped | 23 | 51 | 2.2 | AKP-G015 | 2.4 | 85/15 | 10 parts PVA and 5 parts polyurethane |
| Example 16 | PL-2 | Peanut-shaped | 23 | 51 | 2.2 | AKP-G015 | 2.4 | 50/50 | 10 parts PVA and 5 parts polyurethane |
| Example. 17 | PL-2 | Peanut-shaped | 23 | 51 | 2.2 | AKP-G015 | 2.4 | 70/30 | 10 parts PVA and 5 parts polyurethane |
| Comp. Ex. 5 | — | — | — | — | — | AKP-G015 | 2.4 | 100/0 | 10 parts PVA and 5 parts polyurethane |
| Comp. Ex. 6 | ST-UP | Chain shaped | 12.5 | 170 | 13.6 | AKP-G015 | 2.4 | 70/30 | 10 parts PVA and 5 parts polyurethane |
| Comp. Ex. 7 | ST-AK | Spherical | 15 | 15 | 1.0 | AKP-G015 | 2.4 | 70/30 | 10 parts PVA and 5 parts polyurethane |

| | | Evaluation | | | | |
|---|---|---|---|---|---|---|
| | Under coating layer | Gloss | Ink absorption | | Image clarity | |
| | | | Dye Ink | Pigment ink | Dye ink | Pigment ink |
| Example 11 | Present | ○ | ○ | ○ | ○ | ○ |
| Example 12 | Present | ○ | ○ | ○ | ○ | ○ |
| Example 13 | Present | ○ | ○ | ○ | ○ | ○ |
| Example 14 | Present | ○ | ○ | ○ | ○ | ○ |
| Example 15 | Present | ○ | ○ | ○ | ○ | ○ |
| Example 16 | Present | ○ | ○ | ○ | ○ | ○ |
| Example. 17 | — | ○ | ○ | ○ | ○ | ○ |
| Comp. Ex. 5 | Present | ○ | ○ | Δ | Δ | X |
| Comp. Ex. 6 | Present | Δ | ○ | ○ | Δ | X |
| Comp. Ex. 7 | Present | Δ | X | X | X | X |

The data presented in Table 2 clearly indicated that the inkjet recording quality was good and gloss comparable to that of a silver halide photograph was obtained in each example regardless of whether a dye ink or a pigment ink was used. In addition, the cast coating operations proceeded exceptionally well.

In Comparative Example 5 when colloidal silica was not added, ink absorption declined. In addition, in Comparative Example 6 when a chain shaped colloidal silica having a ratio of secondary particle diameter to primary particle diameter exceeding 2.5 was used, gloss and image clarity were poor. In Comparative. Example 7 when a spherical colloidal silica having the ratio mentioned above of under 1.5 due to lack of aggregation was used, ink absorption and image clarity both declined.

Experiment 3: An Experimental Example of the Third Embodiment

Example 18

(Production of a Base Material)

A stock paper weighing 170 g/m$^2$ was obtained in the manner described in Experiment 1.

(Forming an Undercoating Layer)

An undercoating layer was formed in the manner described in Experiment 1 with the exception that the coating weight of coating solution was 12 g/m$^2$.

(Forming an Ink Absorbing Layer)

Next, a roll coater was used to apply the coating solution B described below at a coating weight of 8 g/m$^2$ on the surface coated with the coating solution A. While the coated layer was wet, a coagulating solution C as described above was used to coagulate the layer. A press roll was used next to press the coated layer onto a heated mirror finished surface to transfer the mirror finished surface, and a cast coated paper for inkjet recording weighing 190 g/m$^2$ was obtained.

Coating solution B: 100 parts of a colloidal silica (Quartron PL-2: a trade name of Fuso Chemical Co., Ltd.) having an average primary particle diameter of 23 nm as the pigment and 10 parts of poly(Vinyl alcohol) (Kuraray 224: a trade name of Kuraray Co., LTD.) having a degree of polymerization of 2,400 as the binder were added to prepare a coating solution having a concentration of 18%.

Example 19

A cast coated paper for inkjet recording was obtained in the manner described in Example 18 with the exception that 0.100 parts of colloidal silica (Quartron PL1: a trade name of Fuso Chemical Co., Ltd.) having an average primary particle diameter of 14 nm was added to the coating solution B in place of the colloidal silica described above.

Example 20

A cast coated paper for inkjet recording was obtained in the manner described in Example 18 with the exception that 100 parts of colloidal silica (Quartron PL3: a trade name of Fuso Chemical Co., Ltd.) having an average primary particle diameter of 35 nm was added to the coating solution B in place of the colloidal silica described above.

Example 21

A cast coated paper for inkjet recording was obtained in the manner described in Example 18 with the exception that 100 parts of colloidal silica (Quartron PL7: a trade name of Fuso Chemical Co., Ltd.) having an average primary particle diameter of 70 nm was added to the coating solution B in place of the colloidal silica described above.

Example 22

A cast coated paper for inkjet recording was obtained; in the manner described in Example 18 with the exception that the coating weight of the undercoating layer was 18 g/m$^2$.

Example 23

A cast coated paper for inkjet recording was obtained in the manner described in Example 18 with the exception that the amount of the poly(vinyl alcohol) mentioned above was 30 parts in the coating solution B.

Example 24

A cast coated paper for inkjet recording was obtained in the manner described in Example 18 with the exception that the amount of the poly(vinyl alcohol) mentioned above was 60 parts in the coating solution B.

Example 25

A cast coated paper for inkjet recording was obtained in the manner described in Example 18 with the exception that 10 parts of casein was added in place of the poly(vinyl alcohol) mentioned above as the binder in the coating solution B and, in addition, using the coagulation solution C2 described below in place of the coagulation solution C.

Coagulation solution C2: An ammonium formate having a concentration of 10% and 0.2% of a mold releasing agent (FL-48C: Toho Chemical Industry. Co.; Ltd.) were added to prepare a coagulating solution.

Comparative Example 8

A cast coated paper for inkjet recording was obtained in the manner described in Example 18 with the exception that 100 parts of synthetic silica (Finesil X-37) was added in place of the colloidal silica described above in the coating solution B.

Comparative Example 9

A cast coated paper for inkjet recording was obtained in the manner described in Example 18 with the exception that 100 parts of chain shaped colloidal silica (ST-UP: a trade name of Nissan Chemical Industries, Ltd.) having a primary particle diameter of 12.5 nm was added in place of the colloidal silica described above in the coating solution B.

Comparative Example 10

A cast coated paper for inkjet recording was obtained in the manner described in Example 18 with the exception of using 100 parts of a chain shaped colloidal silica (PS-MO: a trade name of Nissan Chemical Industries, Ltd.) having a primary particle diameter of 22 nm was added in place of the colloidal silica described above in the coating solution B.

Comparative Example 11

A cast coated paper for inkjet recording was obtained in the manner described in Example 18 with the exception of using 100 parts of a cluster shaped colloidal silica (HS-M-20: a trade name of Nissan Chemical Industries, Ltd.) having a primary particle diameter of 25 nm was added in place of the colloidal silica described above in the coating solution B.

Comparative Example 12

A cast coated paper for inkjet recording was obtained in the manner described in Example 18 with the exception of using 100 parts of a cluster shaped colloidal silica (HS-ZL: a trade name of Nissan Chemical Industries, Ltd.) having a primary particle diameter of 78 nm was added in place of the colloidal silica described above in the coating solution B.

Comparative Example 13

A cast coated paper for inkjet recording was obtained in the manner described in Example 18 with the exception of using 100 parts of a spherical colloidal silica (Snowtex ST-30: a trade name of Nissan Chemical Industries, Ltd., single silica that is not aggregated) having a primary particle diameter of 15 nm was added in place of the colloidal silica described above in the coating solution B.

(Evaluations)

The cast coated paper for inkjet recording obtained in individual examples and comparative examples were evaluated according to the same methods used in Experiment 1. The secondary particle diameter of silica was measured using a Coulter N4 counter (a trade name of the Beckman Coulter, Inc.) and the average number value of particle diameter was used.

The results obtained are shown in Table 3.

TABLE 3

| | Ink absorbing layer | | | | | |
|---|---|---|---|---|---|---|
| | Pigment (colloidal silica) | | | | | |
| | Trade name | Shape | Primary particle diameter (nm) | Secondary particle diameter (nm) | Secondary particle diameter/primary particle diameter | content of binder (PVA) (parts by weight) |
| Example 18 | PL-2 | Peanut-shaped | 23 | 51 | 2.2 | 10 |
| Example. 19 | PL-1 | Peanut-shaped | 14 | 33 | 2.3 | 10 |
| Example 20 | PL-3 | Peanut-shaped | 35 | 70 | 2.0 | 10 |
| Example 21 | PL-7 | Peanut-shaped | 70 | 120 | 1.7 | 10 |
| Example 22 | PL-2 | Peanut-shaped | 23 | 51 | 2.2 | 10 |
| Example 23 | PL-2 | Peanut-shaped | 23 | 51 | 2.2 | 30 |
| Example 24 | PL-2 | Peanut-shaped | 23 | 51 | 2.2 | 60 |
| Example 25 | PL-2 | Peanut-shaped | 23 | 51 | 2.2 | 10 (casein) |
| Comp. Ex. 8 | X-37 | Synthetic silica | 20 | 2700 | 135 | 10 |
| Comp. Ex. 9 | ST-UP | Chain shaped | 12.5 | 170 | 13.6 | 10 |
| Comp. Ex. 10 | PS-MO | Chain shaped | 22 | 115 | 5.2 | 10 |
| Comp. Ex. 11 | ST-HS-M20 | Cluster shaped | 25 | 278 | 11.1 | 10 |
| Comp. Ex. 12 | HS-ZL | Cluster shaped | 78 | 318 | 4.1 | 10 |
| Comp. Ex. 13 | ST-30 | Spherical | 15 | 15 | 1.0 | 10 |

| | Undercoating layer | | Ink absorption | | Image clarity | |
|---|---|---|---|---|---|---|
| | Coating weight (g/m$^2$) | Gloss | Dye ink | Pigment ink | Dye ink | Pigment ink |
| Example 18 | 8 | ○ | ○ | ○ | ○ | ○ |
| Example. 19 | 8 | ○ | ○ | ○ | ○ | ○ |
| Example 20 | 8 | ○ | ○ | ○ | ○ | ○ |
| Example 21 | 8 | ○ | ○ | ○ | Δ | ○ |
| Example 22 | 18 | ○ | ○ | ○ | ○ | ○ |
| Example 23 | 8 | ○ | ○ | ○ | ○ | ○ |
| Example 24 | 8 | ○ | Δ | Δ | ○ | ○ |
| Example 25 | 8 | ○ | ○ | ○ | Δ | Δ |
| Comp. Ex. 8 | 8 | Δ | ○ | ○ | X | Δ |
| Comp. Ex. 9 | 8 | ○ | ○ | ○ | X | Δ |
| Comp. Ex. 10 | 8 | ○ | ○ | ○ | X | X |
| Comp. Ex. 11 | 8 | ○ | ○ | ○ | X | Δ |
| Comp. Ex. 12 | 8 | ○ | ○ | ○ | X | X |
| Comp. Ex. 13 | 8 | ○ | X | Δ | ○ | ○ |

The data presented in Table 3 clearly indicated that, both gloss and inkjet recording adaptability were excellent in each example regardless of whether a dye ink or a pigment ink was used. In addition, the cast coating operations proceeded exceedingly well. In Example 21 when the primary particle diameter of the colloidal silica exceeded 40 nm, the image clarity of the dye ink was slightly inferior to that of other Examples, but no practical problems were encountered. In addition, the ink absorption was slightly inferior but no practical problems were encountered in Example 24 where the content ratio represented by (colloidal silica)/(binder (PVA)) was under 100/50. In Example 25 where casein was used as the binder in place of PVA, the image clarity was slightly inferior to that of other Examples, but, no practical problems were encountered.

However, in Comparative Example 8 when a synthetic silica having a secondary particle diameter of 2.7 μm (the ratio of the secondary particle diameter to the primary particle diameter was 135) as the pigment in the ink absorbing layer, the image clarity declined extensively. In Comparative Examples 9 and 10 when a chain shaped colloidal silica was used as the pigment in the ink absorbing layer and in the cases of Comparative Examples 11 and 12 when a cluster shaped colloidal silica was used, the image clarity declined extensively in all cases. In Comparative Example 13 when a spherical colloidal silica having the ratio of the secondary particle diameter to the primary particle diameter was under 1.5, the ink absorption declined extensively. (For convenience, the primary particle diameter=the secondary particle diameter since the particles did not aggregate and secondary particles did not exist. The same treatment was used for the remaining examples.)

Experiment 4: An Experimental Example of the Fourth Embodiment

Example 26

(Production of a Base Material)

Four parts of calcium carbonate, 1 part of cationized starch, 0.3 part of polyacrylamide and 0.5 part of an alkyl ketene dimer emulsion were added to 100 parts of a pulp which had freeness of 350 ml c.s.f. by beating hard wood kraft pulp (L-BKP), and a fourdrinier paper machine was used in an ordinary process to make paper. The paper was pre-dried and was coated with a solution of 5% phosphoric acid esterified starch and 0.5% of poly(vinyl alcohol) using a size press to a dry weight of 3.2 g/$m^2$. The paper was subsequently dried and subjected to machine calendering to obtain a stock paper weighing 100 g/$m^2$.

(Forming an Undercoating Layer)

No undercoating layer was formed.

(Forming an Ink Absorbing Layer)

Next a comma coater was used to apply the coating solution B4 described below on one side of the stock paper at a coating weight of 18 g/$m^2$. While the coated layer was wet, a coagulation solution C4 was used to coagulate the layer. A press roll was used to press the coated layer onto a heated mirror finished surface to transfer the mirror finished surface, and a cast coated paper for inkjet recording was obtained.

Coating solution B4: 80 parts of synthetic non-crystalline silica formed using a wet method (a sedimentation method) (Finesil X-37B, a trade name of Tokuyama Corp; BET specific surface area from 260 $m^2$ g to 320 $m^2$/g) and 20 parts of colloidal silica (Quartron PL-3: a trade name of Fuso Chemical Co., Ltd.) having a primary particle diameter of 35 nm as the pigment, 30 parts of styrene-butadiene latex (SBR) (SN-335R: a trade name of NIPPON A&L INC.) and 10 parts of casein (ALACID lactic casein, produced in New Zealand) as the binder and also 5 parts of a mold releasing agent (Nopcote C-104H: a trade name of San Nopco Limited) was added to prepare a coating solution having a concentration of 25% in terms of solid content.

Coagulation solution C4: A solution containing 5% of calcium formate (by ASAHI CHEMICAL INDUSTRY CO.) and 1% of a dye fixing agent (Dyefix YK-50: a trade name of DAIWA CHEMICAL INDUSTRIES CO., LTD.) was used.

Example 27

A cast coated paper for inkjet recording was obtained in the manner described in Example 26 with the exception that 20 parts of colloidal silica (Quartron PL-5: a trade name of Fuso Chemical Co., Ltd.) having a primary particle diameter of 52 nm was added in place of the colloidal silica described above in the coating solution B4.

Example 28

A cast coated paper for inkjet recording was obtained in the manner described in Example 26 with the exception of using the coating solution B41 described below in place of the coating solution B4.

Coating solution B41: 95 parts of a synthetic non-crystalline silica formed using a wet method (a sedimentation method) (Finesil X-37B: a trade name of Tokuyama Corp. BET specific surface area from 260 $m^2$/g to 320 $m^2$/g) and 5 parts of a colloidal silica (Quartron PL-7: a trade name of Fuso Chemical Co., Ltd.) having a primary particle diameter of 72 nm as the pigment, 30 parts of a styrene-butadiene latex (SBR) (SN-335R: a trade name of NIPPON A&L INC.) and 10 parts of casein (ALACID lactic casein, produced in New Zealand) as the binder and also 5 parts of a mold releasing agent (Nopcote C-104-H: a trade name of San Nopco Limited) was added to prepare a coating solution having a concentration of 25% in terms of solid content.

Example 29

A cast coated paper for inkjet recording was obtained in the manner described in Example 28 with the exception that the amount of the synthetic non-crystalline silica described above was 90 parts and the amount of the colloidal silica was 10 parts in the coating solution B41.

Example 30

A cast coated paper for inkjet recording was obtained in the manner described in Example 28 with the exception that the amount of the synthetic non-crystalline silica described above was 80 parts and the amount of the colloidal silica was 20 parts in the coating solution B41.

Example 31

A cast coated paper for inkjet recording was obtained in the manner described in Example 28 with the exception that the amount of the synthetic non-crystalline silica described above was 70 parts and the amount of the colloidal silica was 30 parts in the coating solution B41.

Example 32

A cast coated paper for inkjet recording was obtained in the manner described in Example 28 with the exception that the amount of the synthetic non-crystalline silica described above was 60 parts and the amount of the colloidal silica was 40 parts in the coating solution B41.

Comparative Example 14

A cast coated paper for inkjet recording was obtained in the manner described in Example 26 with the exception that 20 parts of a spherical colloidal silica (Snowtex N30G: a trade name of Nissan Chemical Industries, Ltd., present as single silica that is not aggregated) having an average primary particle diameter of 10 nm to 20 nm was added in place of the colloidal silica mentioned above to prepare the coating solution B4.

Comparative Example 15

A cast coated paper for inkjet recording was obtained in the manner described in Example 31 with the exception that 30 parts of a chain shaped colloidal silica (Snowtex ST-UP: a trade name of Nissan Chemical Industries, Ltd.) having an average primary particle diameter of 12.5 nm was added in place of the colloidal silica mentioned above to prepare the coating solution B41.

Comparative Example 16

A cast coated paper for inkjet recording was obtained in the manner described in Example 26 with the exception that 20 parts of aggregated colloidal silica (AEROSIL50 a trade name of NIPPON AEROSIL CO., LTD) having an average primary particle diameter of 30 nm was added in place of the colloidal silica mentioned above to prepare the coating solution B4.

(Evaluations)

The cast coated paper for inkjet recording obtained in individual examples and comparative examples were evaluated according to the same methods used in Experiment 1.

However, the uneven printing was evaluated according to the method described below.

An inkjet printer PM-970C (made by Seiko Epson Corp.) was used to print a cyan solid image with each example. The uneven printing (uneven image density) in printed areas was visually examined and evaluated according to the standards shown below.

◎: A good level with no uneven printing found.

○: A satisfactory level for practical purpose although slight uneven printing was found.

Δ: Some uneven printing found and a rather unsatisfactory level for practical purposes.

X: Severe uneven printing resulting in an impractical outcome.

The secondary particle diameter of colloidal silica was measured using a ZETASIZER 3000HSA of Malvern Instruments. [As far as the silica (trade name: AEROSIL 50) of Comparative Example 16 was concerned, MASTERSIZER S of Malvern Instruments was, used for the measurements.]

The results obtained are shown in Table 4.

TABLE 4

| | Ink absorbing layer | | | | | | | | |
|---|---|---|---|---|---|---|---|---|---|
| | Pigments | | | | | | | | |
| | Colloidal silica | | | | | Wet silica | | Number of parts added | |
| | Trade name | Shape | Primary particle diameter (nm) | Secondary particle diameter (nm) | Secondary particle diameter/primary particle diameter | Trade name | Specific surface area ($m^2/g$) | (colloidal silica/wet silica | Binder |
| Example 26 | PL-3 | Peanut-shaped | 35 | 71.3 | 2.0 | X-37B | 260-320 | 20/80 | 30 parts SBR and 10 parts casein |
| Example 27 | PL-5 | Peanut-shaped | 52 | 107.1 | 2.1 | X-37B | 260-320 | 20/80 | 30 parts SBR and 10 parts casein |
| Example 28 | PL-7 | Peanut-shaped | 72 | 118.7 | 1.7 | X-37B | 260-320 | 5/95 | 30 parts SBR and 10 parts casein |
| Example 29 | PL-7 | Peanut-shaped | 72 | 118.7 | 1.7 | X-37B | 260-320 | 10/90 | 30 parts SBR and 10 parts casein |
| Example. 30 | PL-7 | Peanut-shaped | 72 | 118.7 | 1.7 | X-37B | 260-320 | 20/80 | 30 parts SBR and 10 parts casein |
| Example 31 | PL-7 | Peanut-shaped | 72 | 118.7 | 1.7 | X-37B | 260-320 | 30/70 | 30 parts SBR and 10 parts casein |
| Example 32 | PL-7 | Peanut-shaped | 72 | 118.7 | 1.7 | X-37B | 260-320 | 40/60 | 30 parts SBR and 10 parts casein |
| Comp. Ex. 14 | ST-N30G | Spherical | 10-20 | 10-20 | 1.0 | X-378 | 260-320 | 20/80 | 30 parts SBR and 10 parts casein |
| Comp. Ex. 15 | ST-UP | Chain shaped | 12.5 | 170 | 13.6 | X-37B | 260-320 | 30/70 | 30 parts SBR and 10 parts casein |
| Comp. Ex. 16 | AERO SIL 50 | aggregated | 30 | 620 | 20.7 | X-37B | 260-320 | 20/80 | 30 parts SBR and 10 parts casein |

| | Evaluation | | | | | |
|---|---|---|---|---|---|---|
| | | Ink absorption | | Image clarity | | Cyan |
| | Gloss | Dye Ink | Pigment ink | Dye ink | Pigment ink | uneven printing |
| Example 26 | ○ | ○ | ○ | ○ | ○ | ○ |
| Example 27 | ○ | ○ | ○ | ○ | ○ | ○-◎ |
| Example 28 | ○ | ○ | ○ | ○ | ○ | Δ-○ |
| Example 29 | ○ | ○ | ○ | ○ | ○ | ○ |
| Example. 30 | ○ | ○ | ○ | ○ | ○ | ◎ |
| Example 31 | ○ | ○ | ○ | ○ | ○ | ◎ |
| Example 32 | ○ | ○ | ○ | ○ | ○ | ○ |
| Comp. Ex. 14 | ○ | Δ | Δ | Δ | X | X |
| Comp. Ex. 15 | ○ | Δ | Δ | Δ | X | X |
| Comp. Ex. 16 | X | ○ | ○ | X | X | X |

The data presented in Table 4 clearly indicated that, the inkjet recording quality was good and gloss comparable to that of a silver halide photograph was obtained in each example regardless of whether a dye ink or a pigment ink was used. In addition, the cast coating operations proceeded exceedingly well, and the results of cyan uneven printing evaluation were also excellent. The cyan uneven printing evaluation results were particularly exceptional in Examples 30 and 31 when the primary particle diameter of the colloidal silica was 50 nm or more and the content of that was from 20 parts by weight to 30 parts by weight.

In Comparative Example 14 when spherical colloidal silica having the ratio of the secondary particle diameter to the primary particle diameter of under 1.5 due to lack of aggregation was used, the cyan uneven printing evaluation was poor making this option unsuitable for practical use. In addition, the cyan uneven printing evaluation results were poor making them unsuitable for practical applications in Comparative Examples 15 and 16 when the ratio described above exceeded 2.5.

What is claimed is:

1. An inkjet recording medium obtained by forming a coating layer containing a pigment and a binder on the surface of a base material and said coating layer is subsequently pressed onto a heated mirror finished surface to dry to form an ink absorbing layer through a cast coating method, wherein said pigment contains a peanut-shaped colloidal silica that has a primary particle diameter of from 10 nm to 100 nm while the ratio of the secondary particle diameter to said primary particle diameter is from 1.5 to 2.5.

2. An inkjet recording medium obtained by forming a coating layer containing a pigment and a binder on the surface of a base material, a treatment solution used to coagulate said binder is subsequently applied to said coating layer surface while wet and the coating layer on which said treatment solution is applied is pressed on to a heated minor finished surface while said coating layer is wet to dry the layer to form an ink absorbing layer, wherein said pigment contains a peanut-shaped colloidal silica that has a primary particle diameter of from 10 nm to 100 nm while the ratio of the secondary particle diameter to said primary particle diameter is from 1.5 to 2.5.

3. The inkjet recording medium as defined in claim 1 wherein an undercoating layer is formed between said base material and said ink absorbing layer.

4. The inkjet recording medium as defined in claim 1 wherein the primary particle diameter of said colloidal silica is from 10 nm to 50 nm and said pigment also contains γ-type alumina.

5. The inkjet recording medium as defined in claim 1 wherein the primary particle diameter of said colloidal silica is from 10 nm to 50 nm and said pigment also contains silica formed using a vapor phase method and having a specific surface area of from 130 $m^2/g$ to 300 $m^2/g$.

6. The inkjet recording medium as defined in claim 1 wherein the primary particle diameter of said colloidal silica is from 30 nm to 100 nm and said pigment also contains a synthetic non-crystalline silica formed using a wet method.

7. The inkjet recording medium as defined in claim 1 wherein the content of said colloidal silica is from 5% by weight to 50% by weight based on total pigment in said ink absorbing layer.

8. The inkjet recording medium as defined in claim 1 wherein said binder contains a water soluble resin.

9. The inkjet recording medium as defined in claim 1 wherein said binder contains poly(vinyl alcohol) and/or a poly(vinyl alcohol) derivative.

10. The inkjet recording medium as defined in claim 1 wherein the ratio by weight of the pigment and the binder in said ink absorbing layer satisfies the relationship (pigment)/(binder)=from 100/3 to 100/50.

11. The inkjet recording medium as defined in claim 1 wherein the 75° specular gloss of said ink absorbing layer surface is at least 50% and the degree of image transparency is at least 20%.

12. The inkjet recording medium as defined in claim 2 wherein an undercoating layer is formed between said base material and said ink absorbing layer.

13. The inkjet recording medium as defined in claim 2 wherein the primary particle diameter of said colloidal silica is from 10 nm to 50 nm and said pigment also contains γ-type alumina.

14. The inkjet recording medium as defined in claim 2 wherein the primary particle diameter of said colloidal silica is from 10 nm to 50 nm and said pigment also contains silica formed using a vapor phase method and having a specific surface area of from 130 $m^2/g$ to 300 $m^2/g$.

15. The inkjet recording medium as defined in claim 2 wherein the primary particle diameter of said colloidal silica is from 30 nm to 100 nm and said pigment also contains a synthetic non-crystalline silica fanned using a wet method.

16. The inkjet recording medium as defined in claim 2 wherein the content of said colloidal silica is from 5% by weight to 50% by weight based on total pigment in said ink absorbing layer.

17. The inkjet recording medium as defined in claim 2 wherein said binder contains a water soluble resin.

18. The inkjet recording medium as defined in claim 2 wherein said binder contains poly(vinyl alcohol) and/or a poly(vinyl alcohol) derivative.

19. The inkjet recording medium as defined in claim 2 wherein the ratio by weight of the pigment and the binder in said ink absorbing layer satisfies the relationship (pigment)/(binder)=from 100/3 to 100/50.

20. The inkjet recording medium as defined in claim 2 wherein the 75° specular gloss of said ink absorbing layer surface is at least 50% and the degree of image clarity is at least 20%.

* * * * *